US007168223B2

(12) United States Patent
Caffeo

(10) Patent No.: US 7,168,223 B2
(45) Date of Patent: Jan. 30, 2007

(54) CAPSULE-SEALING MACHINE FOR FOOD OR DRINK CONTAINERS

(75) Inventor: Dangher Caffeo, Casalecchio di Reno (IT)

(73) Assignee: ECOCAP'S s.r.l., Casalecchio di Reno (IT)

( * ) Notice: Subject to any disclaimer, the term of this patent is extended or adjusted under 35 U.S.C. 154(b) by 28 days.

(21) Appl. No.: 10/512,749

(22) PCT Filed: Nov. 19, 2002

(86) PCT No.: PCT/IT02/00732

§ 371 (c)(1),
(2), (4) Date: Oct. 27, 2004

(87) PCT Pub. No.: WO03/099657

PCT Pub. Date: Dec. 4, 2003

(65) Prior Publication Data

US 2005/0160698 A1 Jul. 28, 2005

(30) Foreign Application Priority Data

May 28, 2002 (IT) ..... BO2002A0325

(51) Int. Cl.
*B65B 51/10* (2006.01)
*B65B 7/28* (2006.01)

(52) U.S. Cl. ..... 53/329.2; 53/485; 53/310

(58) Field of Classification Search ..... 53/285, 53/290, 310, 311, 312, 329, 349, 478, 485, 53/488, 329.2, 329.3, 334; 198/624, 625, 198/629

See application file for complete search history.

(56) References Cited

U.S. PATENT DOCUMENTS

| | | | | |
|---|---|---|---|---|
| 1,629,599 | A * | 5/1927 | Tevander | 53/137.1 |
| 2,522,657 | A * | 9/1950 | Wilcox | 432/52 |
| 3,214,886 | A * | 11/1965 | Pechmann | 53/304 |
| 4,104,845 | A * | 8/1978 | Hoffmann | 53/410 |
| 4,222,214 | A * | 9/1980 | Schultz et al. | 53/309 |
| 4,412,797 | A * | 11/1983 | Murayama | 425/114 |
| 4,613,397 | A * | 9/1986 | Buchholz | 156/476 |
| 4,691,500 | A * | 9/1987 | Danforth et al. | 53/478 |
| 4,719,739 | A | 1/1988 | Foldesi | |
| 4,816,110 | A | 3/1989 | Foldesi et al. | |
| 6,508,047 | B1 * | 1/2003 | Groppi | 53/432 |
| 6,708,748 | B1 * | 3/2004 | Kronseder et al. | 156/570 |

FOREIGN PATENT DOCUMENTS

EP 1 070 669 A 1/2001

* cited by examiner

*Primary Examiner*—Stephen F. Gerrity
*Assistant Examiner*—Paul Durand
(74) *Attorney, Agent, or Firm*—Egbert Law Offices

(57) ABSTRACT

The present invention is a capsule-sealing machine that uses a heat-sealing process to apply sterile aluminum blank capsules on food or drink containers or cans, preferably cylindrical in shape but also square, rectangular or oval. The machine includes a conveyor belt that conveys cans to the machine, a loading carousel, a main carousel, where the blank capsules or can covers are sealed onto the cans, an unloading carousel, and an outfeed conveyor belt. The blank capsules are contained in vertical capsule magazines. A series of suction cups removes the blank capsules from the magazines and passes them to another series of suction cups located inside sealing heads of the main carousel. In the main carousel, the cans are raised by the elevating units and come into contact first with the blank capsules and then with the corresponding sealing head.

1 Claim, 8 Drawing Sheets

CAPSULE-SEALING MACHINE FOR FOOD OR DRINK CONTAINERS

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present industrial invention regards an automatic machine that uses a heat-sealing process to apply a sterile aluminum capsule on food or drink containers defined as "tins" or "cans", preferably cylindrical in shape but also square, rectangular or oval.

BACKGROUND OF THE INVENTION

With specific reference to apparatuses of this kind presently available on the market, it may be affirmed that numerous types exist, each classifiable according to the speed at which the capsule is applied and above all the nature of the capsule used.

BRIEF SUMMARY OF THE INVENTION

The present invention regards a highly productive machine that heat seals a single-material aluminum capsule "bonded" with lacquer on the existing can cover. It is distinguished by the innovative solutions devised for the capsule magazine, for the means for picking up and transferring the capsules and raising the can, as well as for the sealing head which seals the capsules on the can rim.

BRIEF DESCRIPTION OF THE SEVERAL VIEWS OF THE DRAWINGS

These and other features will now become more evident in the description of a simple form of execution of the invention, which serves purely illustrative purposes and in no way limits the scope of this patent.

DETAILED DESCRIPTION OF THE INVENTION

Figure 1:
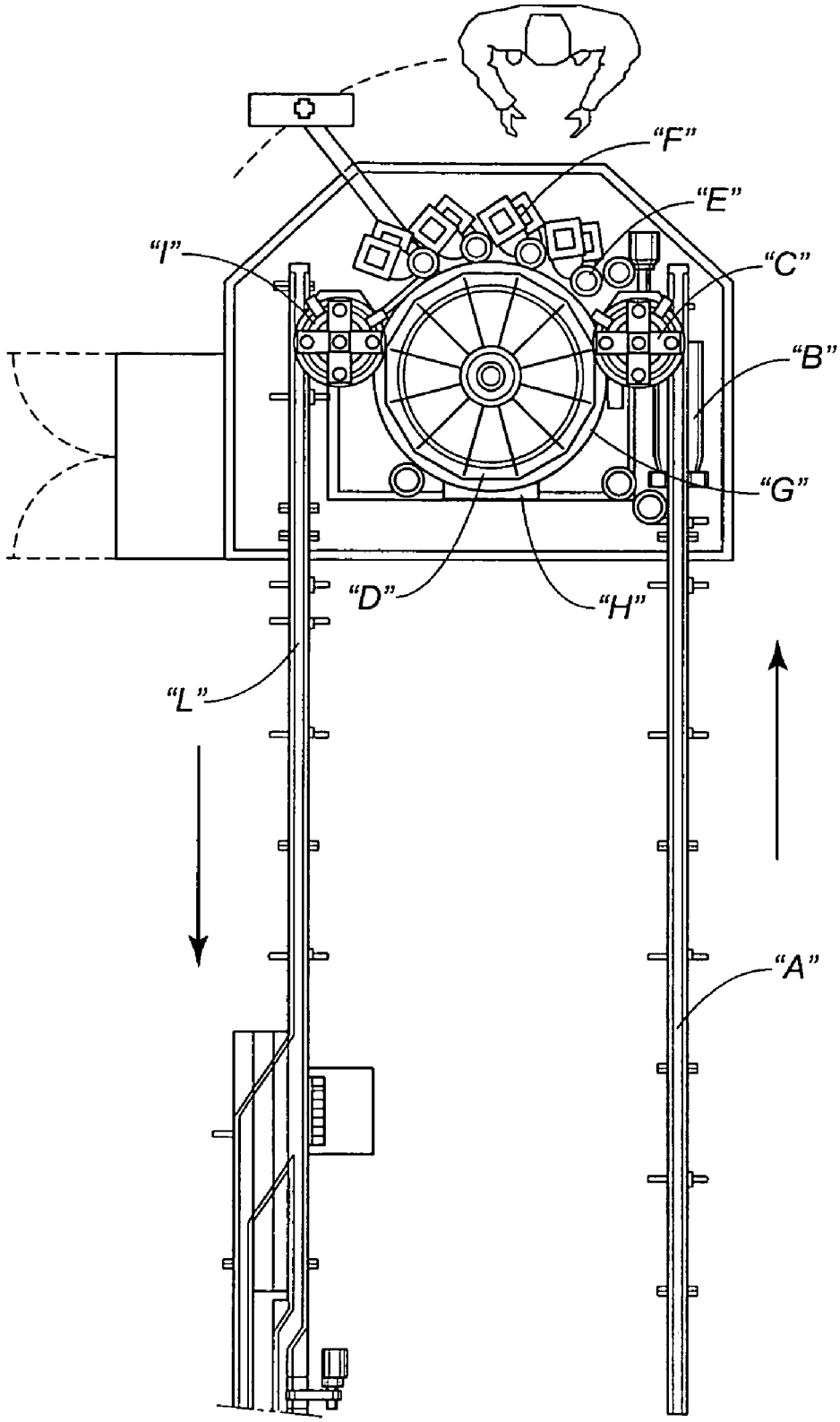
FIG. 1 shows a top plan view of the machine layout.

Referring to FIG. 1, the letter A indicates the conveyor belt that conveys cans to the machine, which, by means of a screw feeder B, spaces them apart and conveys them to a loading carousel C. The loading carousel C transfers the cans to the main carousel D, where the blank capsules or can covers are sealed onto the cans. The blank capsules are contained in vertical capsule magazines "E". Actuated by the capsule pick-up units F, a series of suction cups removes the blank capsules from the magazines and passes them to another series of suction cups located inside the sealing heads G of the main carousel D.

In the main carousel D, the cans are raised by the elevating units H and come into contact first with the blank capsules and then with the corresponding sealing head G. At the end of the sealing process, the cans are transferred to an unloading carousel I and conveyed to the outfeed conveyor belt L.

Figure 2:
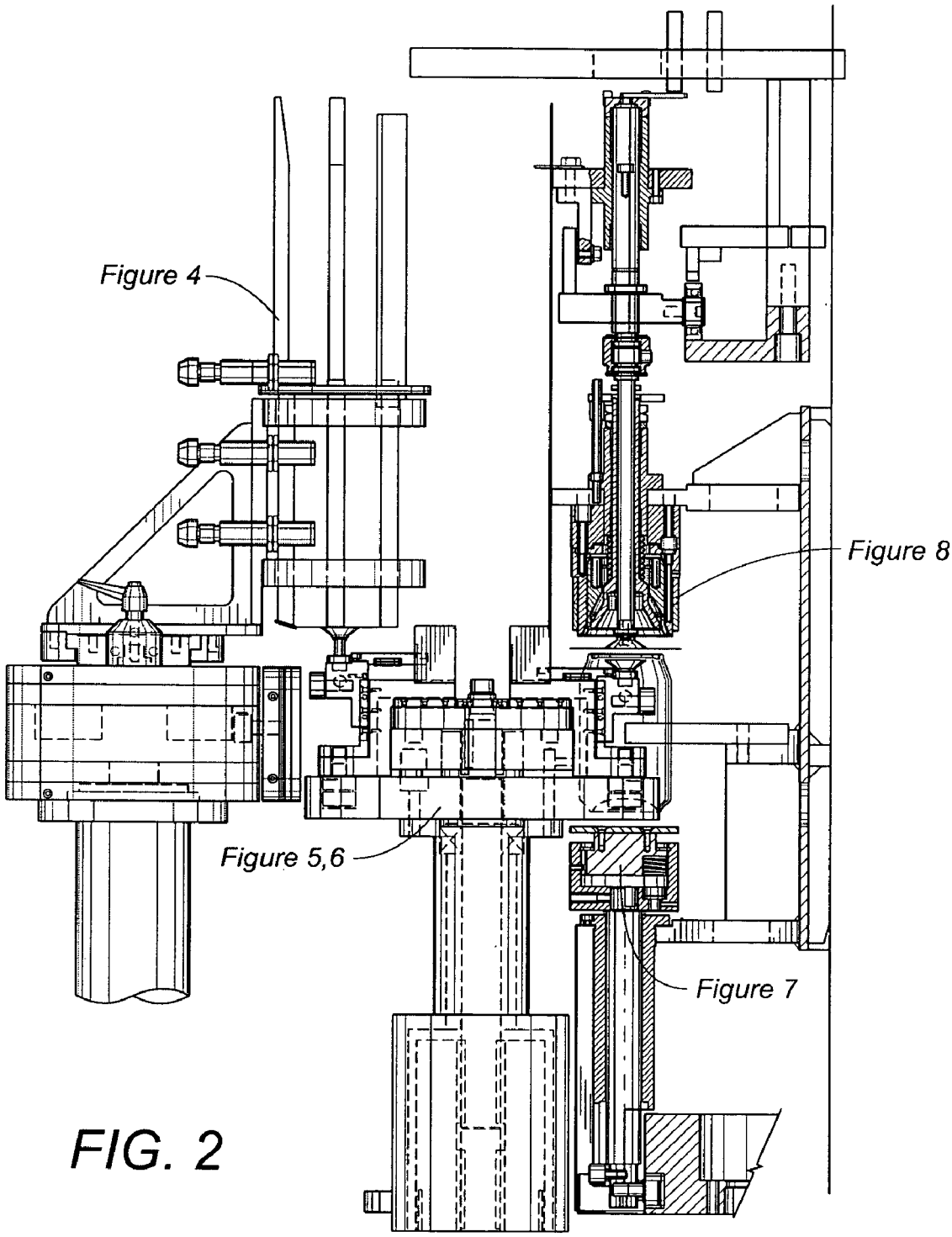
FIG. 2 shows a schematic view of the assembly of the different units which are integral parts of the machine.

FIG. 2 shows the assembly of the different units, the capsule magazine E, the capsule pick-up unit F, the sealing head G, and the elevating unit H, which are integral parts of the machine.

Reference is made to the Figures, according to the operations described.

Figure 3:
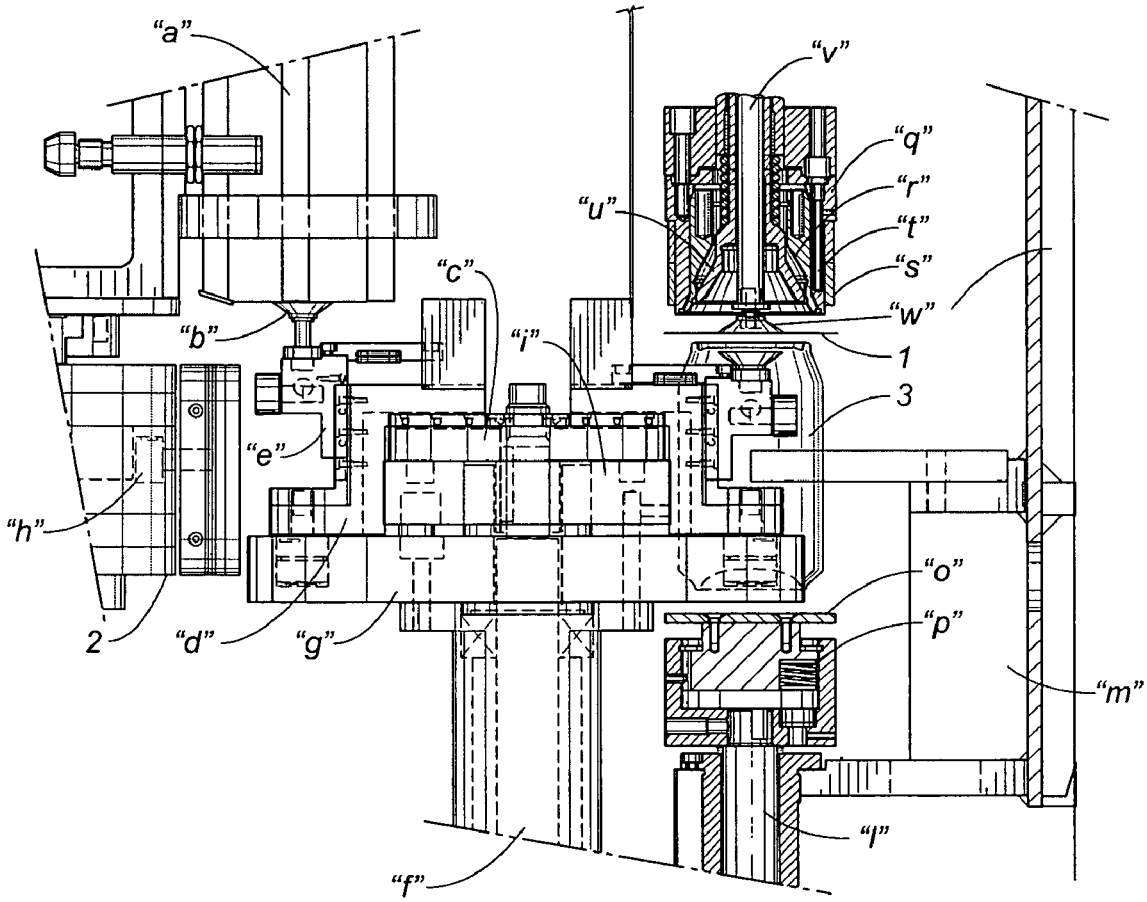
FIG. 3 shows a schematic view of the previous assembly, with letters of reference identifying the components.
Figure 4:
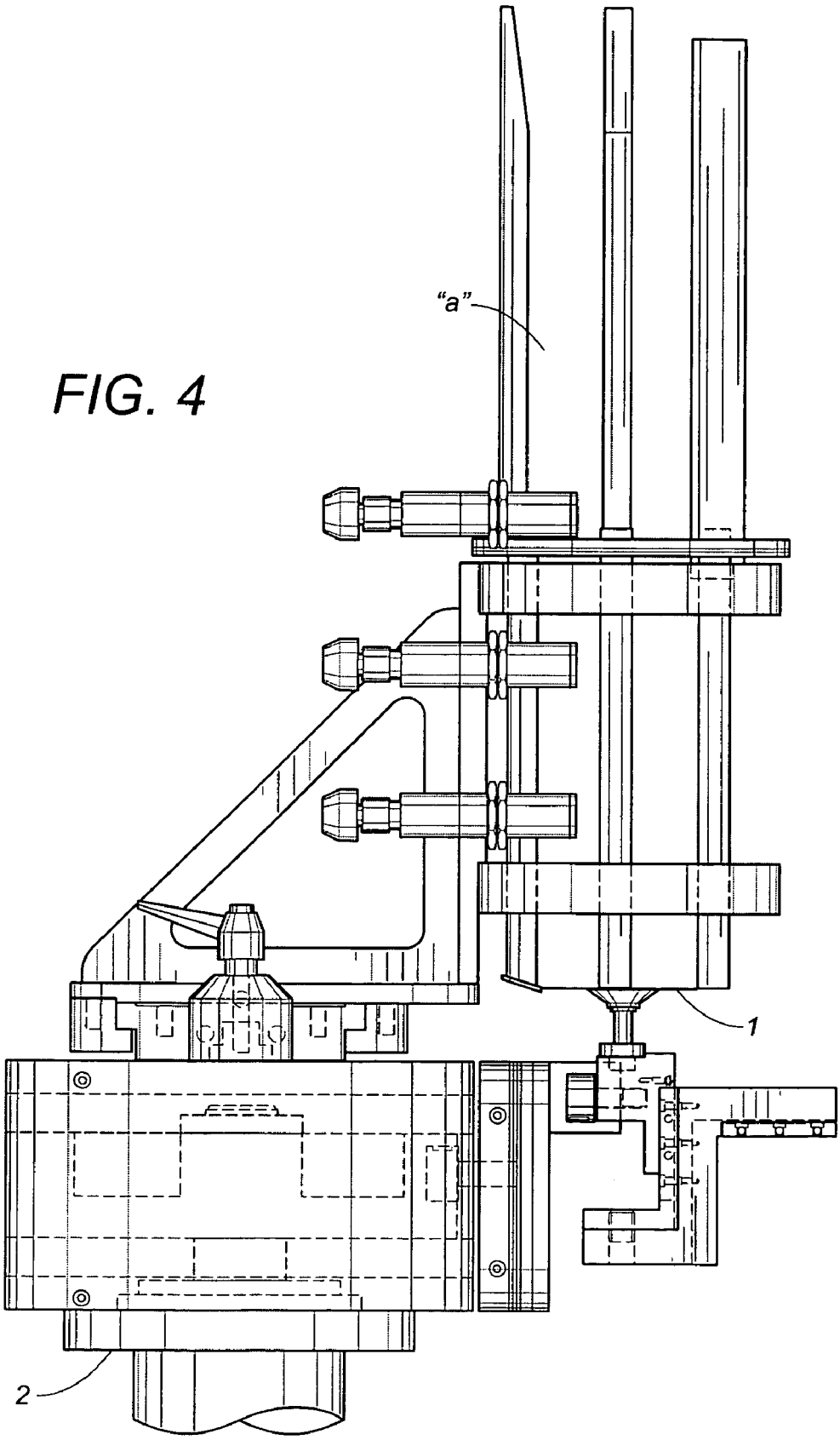
FIG. 4 shows a partial schematic view of the capsule magazine unit.

As shown in FIGS. 3 and 4, the blank capsules l are contained in the vertical magazine rails a and are kept in place by a series of claw elements which prevent the blank capsules l from slipping. The magazine is fixed on level 2 of the machine.

Figure 5:
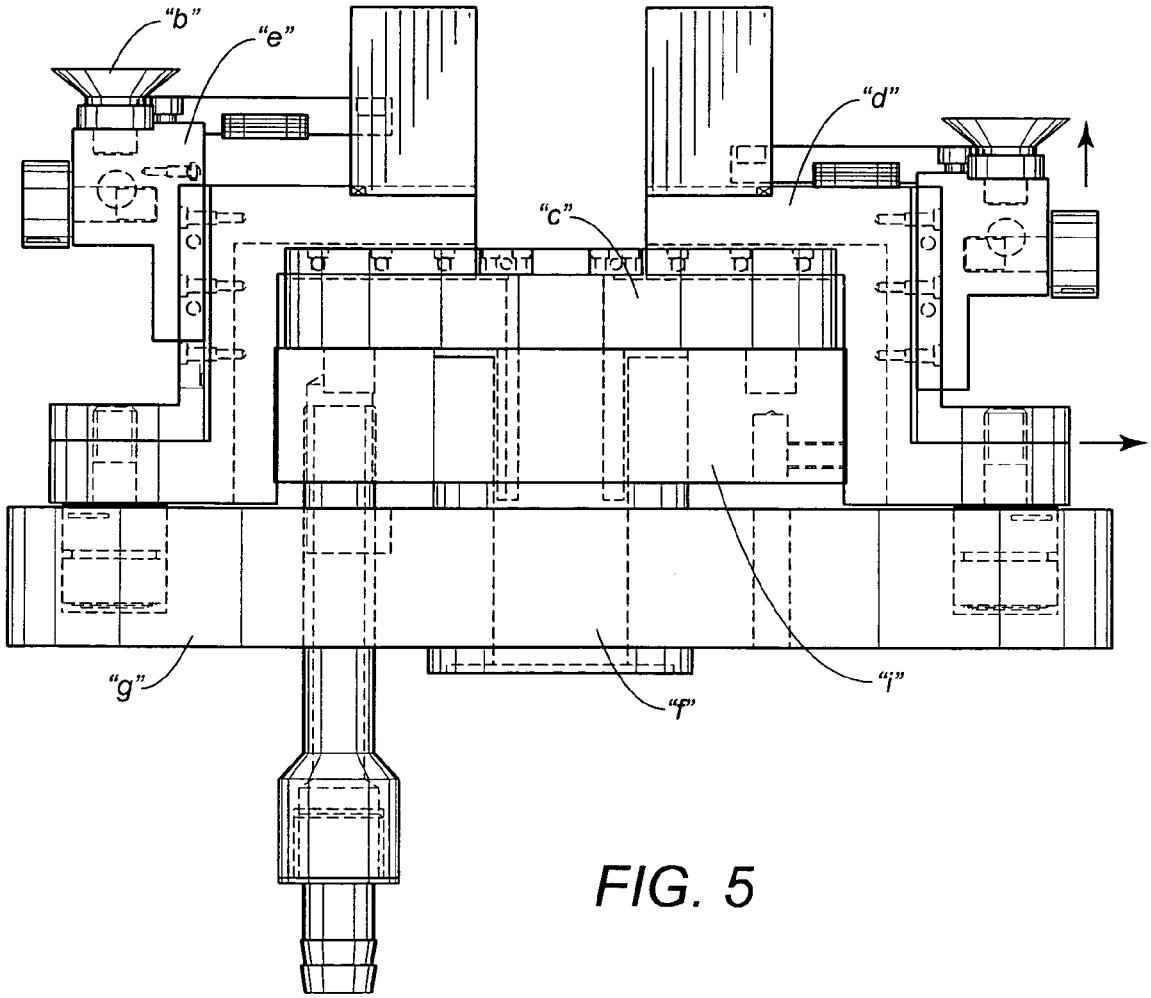
FIG. 5 shows another partial schematic view of the capsule pick-up and transfer unit.
Figure 6:
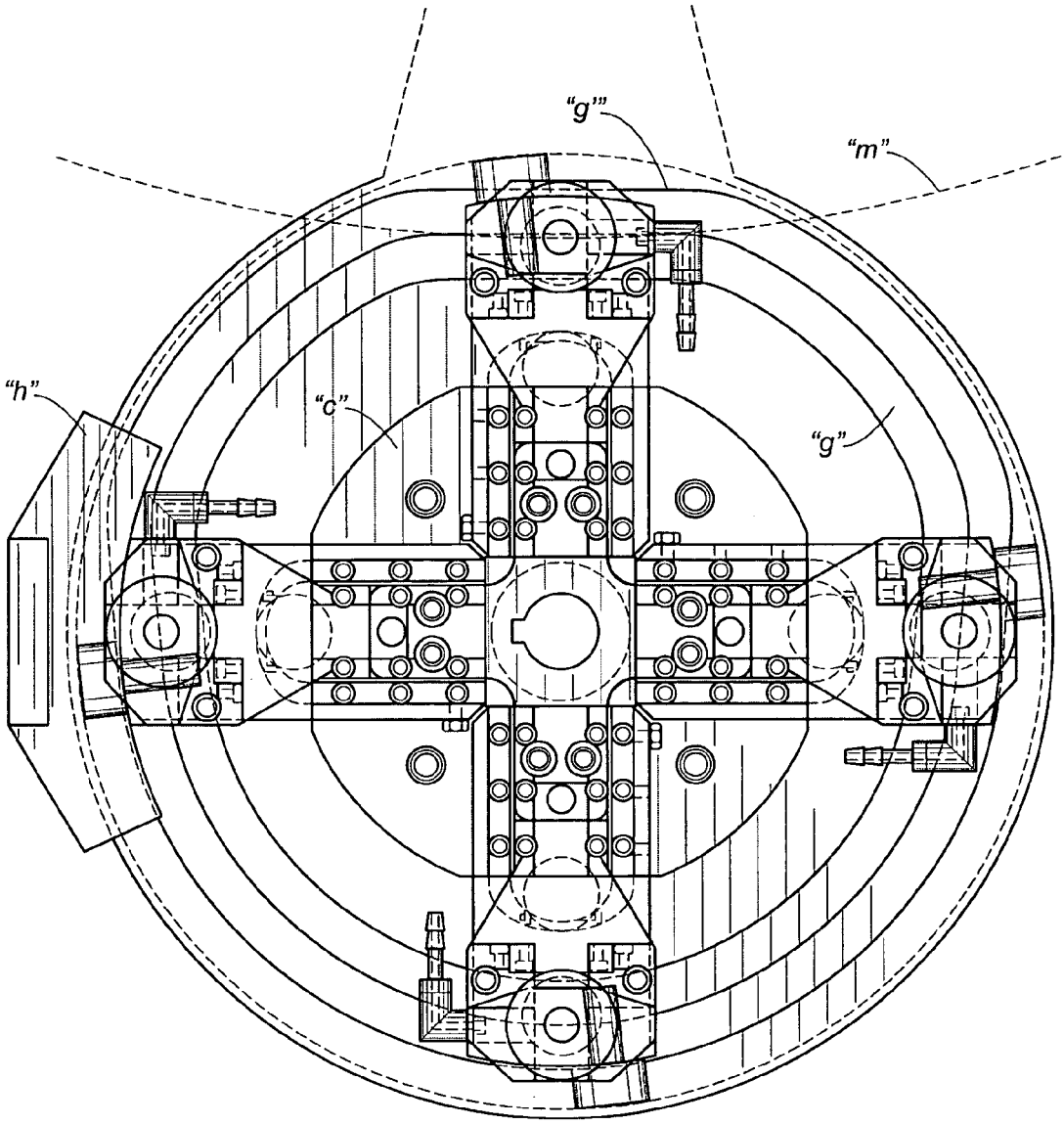
FIG. 6 shows a schematic view of the capsule pick-up and transfer unit as seen from above.

As shown in FIGS. 3, 5 and 6, the intermittent rotation unit with the capsule pick-up unit comprises a main platform c bearing carriages d and e, which travel respectively along a horizontal and vertical axis. The main platform c engages a fixed cam g for alignment with the main carousel D and a rotating cam h for positioning each capsule pick-up unit F in relation to each capsule magazine E.

Each capsule pick-up unit F includes a first suction cup b mounted on carriage e.

The main platform c is moved as the intermittent rotation unit f driven by the main machine motor. During rotation of the intermittent rotation unit f, the rotating cam h turns and brings a first suction cup b into contact with the blank capsules l contained in the capsule magazine E.

The first suction cup b is connected to a vacuum pump by a first grooved cam i. The blank capsule l is held by suction, during alignment of the intermittent rotation unit f by rotating cam h and during the descent of the carriage e. The blank capsule l held by suction is pulled from the capsule magazine E and continues to adhere to the first suction cup b.

At this point, the intermittent rotation unit starts to turn, drawing with it the main platform c and all the parts integral with the latter.

The fixed cam g has a grooved section of length g' with a diameter matching that of the main carousel m.

As the main platform c turns, the carriages d and e travel horizontally outward, their motion being constrained by the fixed cam g so as to match the diameter of the main carousel m. The main carousel m bears the sealing heads G for the length g'. In this matching phase, the speed of the intermittent intervals of rotation of the intermittent rotation unit is corresponds to the rotation speed of the main carousel m. No relative motion occurs between first suction cup b and the sealing head G with a second suction cup w.

The sealing head G includes the second suction cup w integral with a shaft v. The second suction cup w is connected to a vacuum pump by a second grooved cam. For the length of the path followed by the first suction cup b, a clamp cam x causes the second suction cup w on the end of the shaft v, with the vacuum activated, to detach the blank capsule l from the first suction cup b. The blank capsule's transfer from one suction cup to the other is facilitated by the fact that during the matching phase, the vacuum deactivated in the first suction cup b is replaced by a jet of compressed air delivered by the second grooved cam i. At this point, the second suction cup w turns together with the main carousel m and moves away from first suction cup b, taking the blank capsule l with it. The operation is repeated between the next first suction cup b and second suction cup w of the next sealing head.

Figure 7:
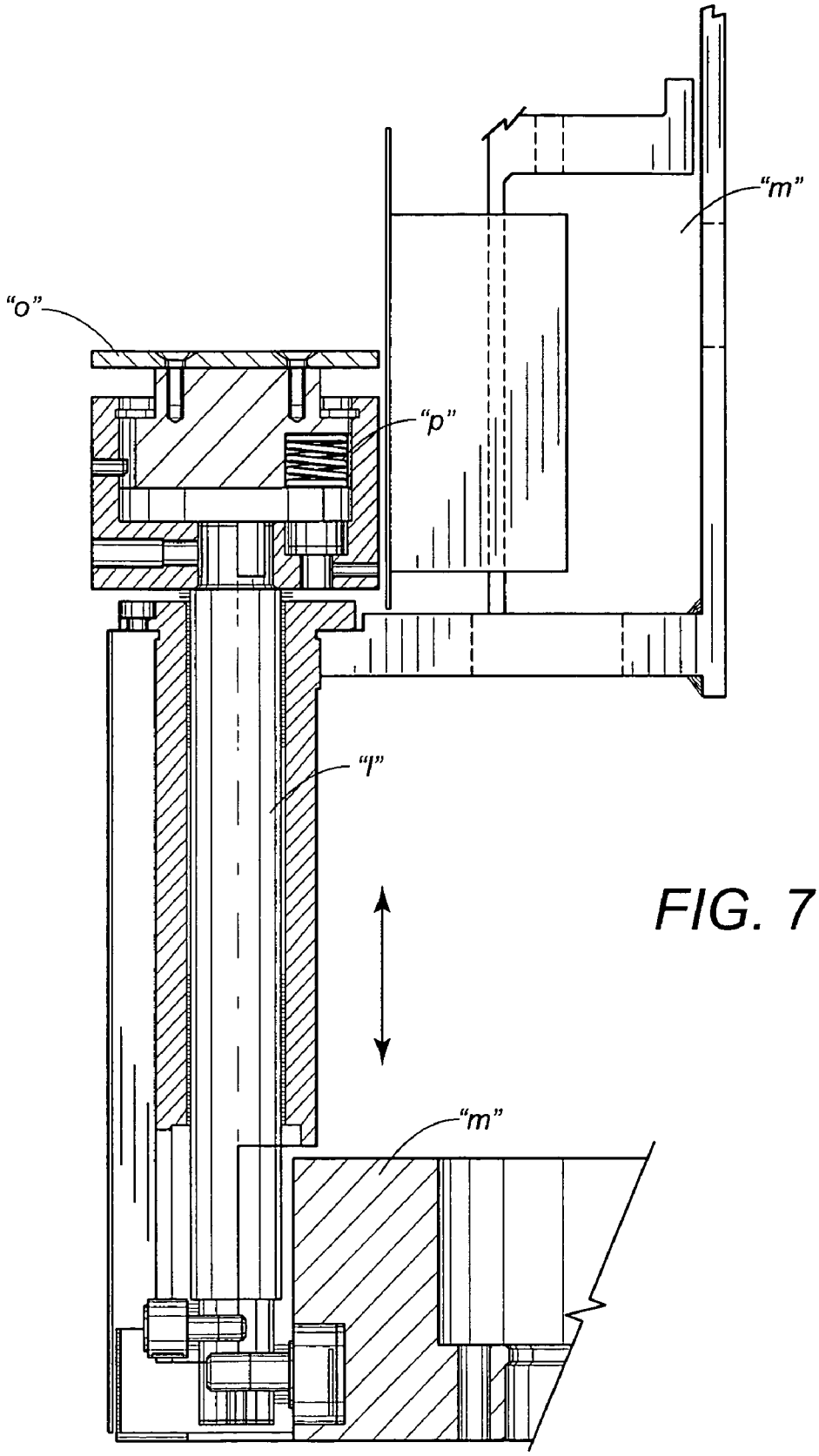
FIG. 7 shows a partial schematic view of the can-elevating unit.

As shown in FIGS. 3 and 7, the elevating unit H comprises an elevating shaft l fixed to the main carousel m and connected to a support plate o.

The support plate o, integral with the elevating shaft l, is the surface upon which the can rests.

The elevating shaft l's movement is constrained by elevating cam n. During the rotation of the main carousel m, the can rises until it comes up against the sealing head G. The support plate o floats, resting upon third springs p. When the elevating shaft l rises, bringing the can into contact with the sealing head G, the third springs p are compressed and exert the necessary thrust to seal the blank capsule l onto the can.

Figure 8:
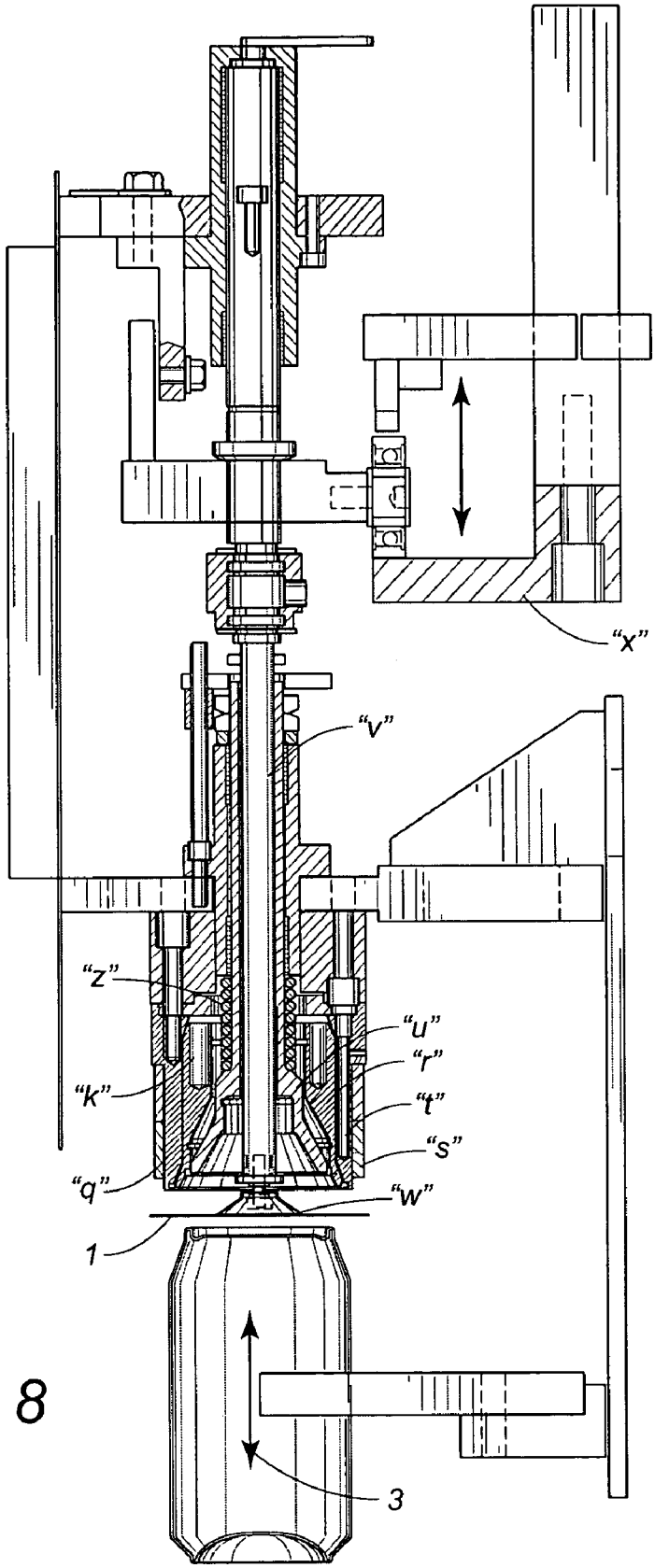
FIG. 8 shows another schematic view of the sealing head unit

As shown in FIGS. 3 and 8, the sealing head G is, integral with the main carousel m, comprises a central casing element q heated by a pair of heating elements scontrolled by the temperature sensor t. The central casing element q is positioned by a first spring.

Each of the two heating elements s has enough power to seal the capsule; therefore, should one heating element fail, an electronic system automatically cuts it out and activates the second heating element. This guarantees the continuity of the machine's operation.

Inside the central casing element q, there is a mobile element r, and, situated inside the central casing element q, is a capsule press-forming device u. The pressing device u travels along the shaft v bearing the second suction cup w and is held in position by a second spring z.

The mobile element r is made up of several independent sector plates to compensate the geometrical tolerances in the can's shape and to produce a seal both on the top rim and the outer side edge of the can. The mobile element r creates the surface for contacting the sealing head G and runs inside the central casing element q. The mobile element r is held in place by a series of springs k.

When the can rises, conveyed by the elevating unit H, it meets the blank capsule l retained by the second suction cup w.

At this point, the shaft v moved by the clamp cam x likewise starts to rise, matching the ascent of the can.

The can continues to rise until it meets the six mobile elements r of the sealing head G.

The blank capsule l, which is now compressed between the can 3 and the press-forming device u, assumes the shape of the inside of a can cover and adheres to the outside of the cover itself, compressed against the mobile elements r.

The can continues to rise, pushing the mobile sectors r upward until the elevating cam n reaches the upper travel limit and the third springs p are duly compressed. The mobile sectors r, opposed by the position of the plurality of springs k, slide along the cone of the central casing element q and clamp the blank capsule l against the outer edge of the can, which is in turn pushed by the third springs p.

Therefore, throughout the time of the elevating cam n in the raised position, the can is pressed against the blank capsule l, which is in turn pressed against the mobile elements r. The mobile elements r, being heated, generate a seal both on the top and side of the can.

At the end of the elevating cam n time in the raised position, the elevating unit H descends, taking with it the sealed can, which is then released and conveyed to subsequent processing lines by the unloading carousel I and along the outfeed conveyor belt L.

I claim:

1. Capsule-sealing machine for food or drink containers comprising:

a conveyor belt with a screw feeder;

a loading carousel aligned with said conveyor belt;

a capsule magazine, mounted in position after said loading carousel and filled with a plurality of blank capsules, said capsule magazine having a plurality of vertical magazine rails and a plurality of claw elements spaced along a length of said vertical magazine rails, said blank capsules being aligned and dispensed from the rails and claw elements;

an intermittent rotation unit having a main platform engaging a fixed cam and rotating cam, a plurality of carriages mounted on a perimeter of said main platform, and a plurality of capsule pick-up units, said main platform being horizontally and vertically mobile as controlled by said fixed cam and said rotating cam, each of said capsule pick-up units having a first suction cup mounted at an extremity of said main platform, each first suction cup being engaged with a first grooved cam, said rotating cam moving said first suction cup towards said capsule magazine during rotation of said fixed cam of said intermittent rotation unit, each first suction cup being connected to a vacuum pump by said first grooved cam, a main carousel having a plurality of sealing heads and a plurality of elevating units, each sealing head having a central casing element with a pair of heating elements, a temperature sensor, and a plurality of mobile elements positioned therein, a capsule press-forming device, and a shaft with a clamp cam, each said central casing element being positioned by a first spring and a partial conical interior shape, said shaft having a second suction cup mounted on an end thereof, said second suction cup being engaged with a second grooved cam, said second suction cup being connected to a vacuum pump by said second grooved cam, said capsule press-forming device traveling along said shaft, being positioned by a second spring within said central casing element, and being capsule-shaped and heated by said pair of heating elements, said mobile elements being comprised of independent sector plates for contacting said central casing element, and being slidable within said central casing element, said mobile elements being positioned by a plurality of springs, said pair of heating elements heating said central casing element, being controlled by said temperature sensor, and functioning autonomously, each elevating unit having a support plate mounted on an elevating shaft, and a third spring engaging said support plate, said elevating shaft having an elevating cam, said elevating cam rotating said support plate towards said sealing unit;

an unloading carousel; and a second conveyor belt with a screw feeder, wherein said main carousel has a radius equal in length to a radius of a grooved section of said fixed cam of said intermittent rotation unit, wherein said main platform of said intermittent rotation unit rotates in intermittent intervals, said carriages being horizontally mobile and constrained by said rotating cam, said carriages aligning with said main carousel at a circumference of said main carousel, wherein said intermittent intervals of rotation of said intermittent rotation unit are synchronized with rotation speed of said main carousel such that said first suction cup and said second suction cup are aligned by motion of said intermittent rotation unit and rotation of said main carousel, and wherein said first grooved cam delivers a jet of compressed air to said first suction cup so as to deactivate a vacuum, said second suction cup replacing the vacuum by said second grooved cam, said second suction cup being moved away from said first suction cup by rotation of said main carousel.

* * * * *